US011746574B2

(12) United States Patent
Kang

(10) Patent No.: US 11,746,574 B2
(45) Date of Patent: Sep. 5, 2023

(54) LOCKING MECHANISM FOR PILLARLESS DOORS

(71) Applicants: Hyundai Motor Company, Seoul (KR); Kia Motors Corporation, Seoul (KR)

(72) Inventor: Seung Kyu Kang, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 387 days.

(21) Appl. No.: 17/039,030

(22) Filed: Sep. 30, 2020

(65) Prior Publication Data

US 2021/0355720 A1 Nov. 18, 2021

(30) Foreign Application Priority Data

May 13, 2020 (KR) ..... 10-2020-0057399

(51) Int. Cl.
*E05B 77/12* (2014.01)
*E05B 83/38* (2014.01)
*E05B 51/02* (2006.01)

(52) U.S. Cl.
CPC ..... *E05B 83/38* (2013.01); *E05B 51/023* (2013.01); *E05B 77/12* (2013.01)

(58) Field of Classification Search
CPC . E05B 77/12; E05B 77/54; E05B 3/06; E05B 63/042
See application file for complete search history.

(56) References Cited

U.S. PATENT DOCUMENTS 2,827,321 A * 3/1958 Leslie ..... E05B 77/48 292/216
3,468,392 A * 9/1969 Hass ..... E05B 77/12 180/281
4,067,154 A * 1/1978 Fike, Jr. ..... H05K 5/068 52/99

* cited by examiner

*Primary Examiner* — Kristina R Fulton
*Assistant Examiner* — Thomas L Neubauer
(74) *Attorney, Agent, or Firm* — Slater Matsil, LLP

(57) ABSTRACT

A locking mechanism for pillarless doors includes a first body mounted on a first side door and having a first cavity, a second body mounted on a second side door and having a second cavity opposite the first cavity, a locking member configured to be movably received between the first cavity of the first body and the second cavity of the second body, and a gas generator including a squib and an inflator chamber containing a gas generant configured to be burned by ignition of the squib, wherein the inflator chamber is separated from the first cavity by a burst membrane.

20 Claims, 12 Drawing Sheets

LOCKING MECHANISM FOR PILLARLESS DOORS

CROSS-REFERENCE TO RELATED APPLICATIONS

This application claims the benefit of Korean Patent Application No. 10-2020-0057399, filed on May 13, 2020, in the Korean Intellectual Property Office, which application is hereby incorporated herein by reference.

TECHNICAL FIELD

The present disclosure relates to a locking mechanism for pillarless doors.

BACKGROUND

In recent years, some vehicles are equipped with pillarless doors from which a center pillar (or B-pillar) has been removed to increase dwelling ability by expanding the interior space of the vehicle.

In order to increase dwelling ability, research and development are being actively carried out on pillarless sliding doors allowing a front side door and a rear side door to slide along a longitudinal direction of the vehicle and removing the center pillar between the front side door and the rear side door.

Meanwhile, the vehicle equipped with the pillarless doors have pillar-like reinforcements embedded in each of the front and rear side doors to prepare for side collisions, and the front and rear side doors are individually reinforced by the reinforcements. However, the pillar structure of the front side door and the pillar structure of the rear side door are not connected to each other. Thus, in the event of a side collision, the front side door and the rear side door may be excessively parted, and a vehicle body may be severely deformed.

To overcome these problems, a center door latch mechanism (or center door locking mechanism) has been proposed between the front side door and the rear side door. However, the opening and closing of the front side door and the opening and closing of the rear side door should be sequentially made, which reduces convenience. The center door latch mechanism increases the weight of the vehicle, and the center door latch mechanism is exposed to the outside, which deteriorates exterior styling.

The above information described in this background section is provided to assist in understanding the background of the inventive concept, and may include any technical concept which is not considered as the prior art that is already known to those skilled in the art.

SUMMARY

The present disclosure relates to a locking mechanism for pillarless doors. Particular embodiments relate to a locking mechanism for pillarless doors mechanically connecting a front side door and a rear side door, thereby providing a load path between the front side door and the rear side door in the event of a side collision.

The present disclosure solves problems occurring in the prior art while advantages achieved by the prior art are maintained intact.

An embodiment of the present disclosure provides a locking mechanism for pillarless doors mechanically connecting a front side door and a rear side door, thereby providing a load path between the front side door and the rear side door in the event of a side collision.

According to an embodiment of the present disclosure, a locking mechanism for pillarless doors may include a first body mounted on a first side door and having a first cavity, a second body mounted on a second side door and having a second cavity opposite the first cavity, a locking member movably received between the first cavity of the first body and the second cavity of the second body, and a gas generator including a squib and an inflator chamber containing a gas generant to be burned by ignition of the squib, wherein the inflator chamber may be separated from the first cavity by a burst membrane.

The first cavity may have a volume capable of receiving the whole locking member, and the second cavity may have a volume capable of receiving a portion of the locking member.

The first body may include a first opening communicating with the first cavity, and the first opening may be located opposite the second body.

The second body may include a second opening communicating with the second cavity, and the second opening may be located opposite the first body.

The second body may include a plurality of vent holes communicating with the second cavity, and the plurality of vent holes may face the second opening.

The first body may be aligned with the second body in a longitudinal direction of a vehicle when the first side door and the second side door are closed.

The locking member may include a first end face facing the second body and a second end face facing the burst membrane.

When the gas generator operates, the locking member may move toward the second cavity of the second body so that the first end face of the locking member may be received in the second cavity of the second body, and the second end face of the locking member may be received in the first cavity of the first body.

The locking member may include a third cavity receiving a gas generated by the gas generator, a plurality of vent holes communicating with the third cavity, and a third opening communicating with the third cavity. The plurality of vent holes may be provided in the first end face, and the third opening may be provided in the second end face.

The locking member may include a first through hole communicating with the third cavity, a first locking pin movably received in the first through hole, a second through hole communicating with the third cavity, and a second locking pin movably received in the second through hole, and the first locking pin and the second locking pin may be moved toward the outside of the locking member by a pressure of the gas received in the third cavity.

The first body may include a first locking recess communicating with the first cavity, and the second body may include a second locking recess communicating with the second cavity. When the first end face of the locking member contacts an inner surface of the second body by the operation of the gas generator, the first through hole may be aligned with the first locking recess, and the second through hole may be aligned with the second locking recess.

The first body may include a plurality of tearing plates disposed around the first opening. The plurality of tearing plates may support a first end face of the locking member when the gas generator does not operate, and each tearing plate may be made of a frangible material which is breakable by a predetermined force.

The burst membrane may be made of a frangible or rupturable material which is ruptured when a pressure in the inflator chamber is higher than or equal to a predetermined pressure.

BRIEF DESCRIPTION OF THE DRAWINGS

The above and other objects, features and advantages of the present disclosure will be more apparent from the following detailed description taken in conjunction with the accompanying drawings, in which.

DETAILED DESCRIPTION OF ILLUSTRATIVE EMBODIMENTS

Figure 1:
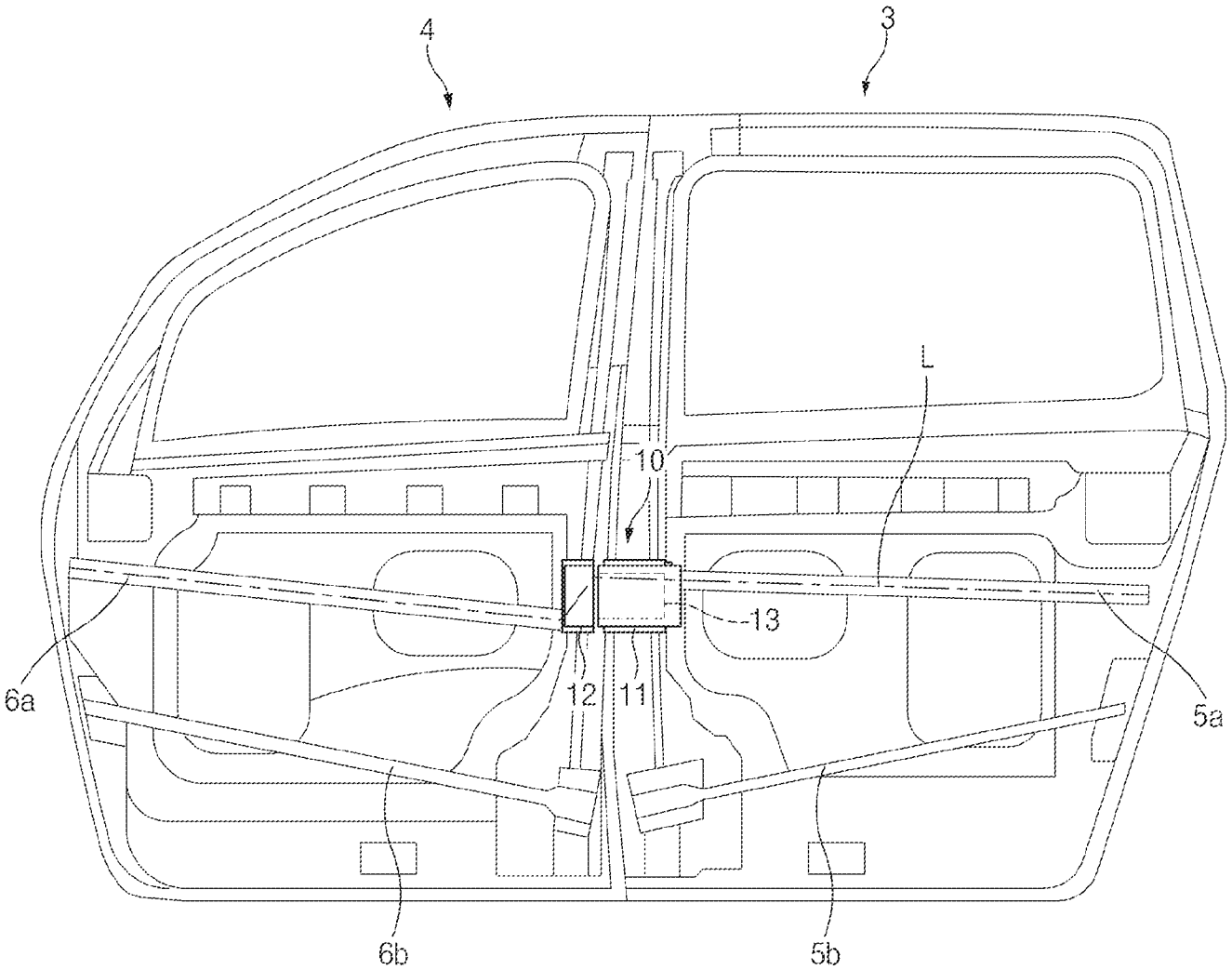
FIG. 1 illustrates a locking mechanism for pillarless doors according to an exemplary embodiment of the present disclosure, which is mounted on side doors of a vehicle.
Figure 2:
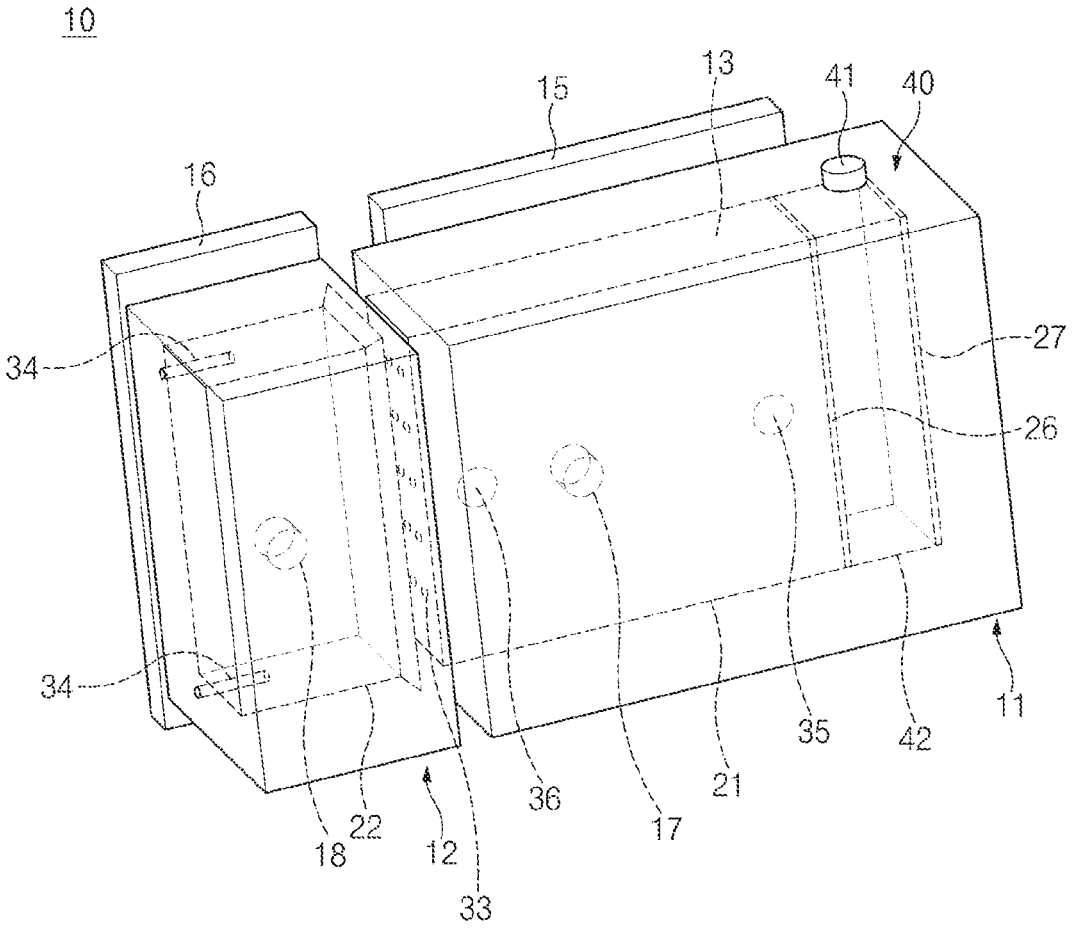
FIG. 2 illustrates a perspective view of a locking mechanism for pillarless doors according to an exemplary embodiment of the present disclosure.

Hereinafter, exemplary embodiments of the present disclosure will be described in detail with reference to the accompanying drawings. In the drawings, the same reference numerals will be used throughout to designate the same or equivalent elements. In addition, a detailed description of well-known techniques associated with the present disclosure will be omitted in order not to unnecessarily obscure the gist of the present disclosure.

Terms such as first, second, A, B, (a), and (b) may be used to describe the elements in exemplary embodiments of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

Referring to FIGS. 1 to 7, a locking mechanism 10 for pillarless doors according to an exemplary embodiment of the present disclosure may include a first body 11 having a first cavity 21, a second body 12 having a second cavity 22, and a locking member 13 movably received in the first cavity 21 of the first body 11 and the second cavity 22 of the second body 12.

Referring to FIG. 1, a vehicle may have a first side door 3 and a second side door 4 mounted on the side of the vehicle, which constitute pillarless doors by removing a center pillar between the first side door 3 and the second side door 4. The first body 11 may be mounted on the first side door 3, and the second body 12 may be mounted on the second side door 4. The first body 11 may be spaced apart from and aligned with the second body 12. The first body 11 may be mounted on an inner panel or an inner trim of the first side door 3, which is not exposed to the interior or exterior of the vehicle, using fasteners and/or the like. The second body 12 may be mounted on an inner panel or an inner trim of the second side door 4, which is not exposed to the interior or exterior of the vehicle, using fasteners and/or the like.

According to an exemplary embodiment, as illustrated in FIG. 1, the first side door 3 may be a rear side door adjacent to the rear of the vehicle, and the second side door 4 may be a front side door adjacent to the front of the vehicle. The first body 11 may be mounted on a front end of the rear side door, and the second body 12 may be mounted on a rear end of the front side door.

According to an alternative exemplary embodiment, the first side door 3 may be a front side door, and the second side door 4 may be a rear side door. That is, the first body 11 may be mounted on a rear end of the front side door, and the second body 12 may be mounted on a front end of the rear side door.

Referring to FIGS. 2 to 8, the first body 11 may include the first cavity 21 receiving the locking member 13, and a first opening 21*a* communicating with the first cavity 21. The first cavity 21 may be defined inside the first body 11. The first body 11 may have a closed wall 11*a* facing the first opening 21*a*. The first cavity 21 may be open to the second body 12 through the first opening 21*a*, and the first opening 21*a* may be located opposite the second body 12. In particular, the first cavity 21 may have a volume capable of receiving the whole locking member 13, and thus the locking member 13 may be completely received in the first cavity 21 through the first opening 21*a*.

Referring to FIGS. 5 to 8, the first body 11 may include a first locking recess 17 and a first tooling hole 17*a* which communicate with the first cavity 21. The first cavity 21 may be defined within the first body 11, and the first cavity 21 may have a shape corresponding to that of the locking member 13, so that the locking member 13 may be movably received in the first cavity 21 of the first body 11. The first locking recess 17 may be aligned with the first tooling hole 17*a* in a width direction of the first body 11, and the first locking recess 17 and the first tooling hole 17*a* may be formed by drilling in the width direction of the first body 11. The first locking recess 17 may be provided in one sidewall of the first body 11, and the first tooling hole 17*a* may be provided in the other sidewall of the first body 11. The first locking recess 17 and the first tooling hole 17*a* may face each other in relation to the first cavity 21. The first locking recess 17 may be formed not to be through one sidewall of the first body 11, and the first tooling hole 17*a* may be formed to be through the other sidewall of the first body 11.

Referring to FIGS. 2 to 7 and 9, the second body 12 may include the second cavity 22 receiving a portion of the locking member 13, a second opening 22*a* communicating with the second cavity 22, and a plurality of vent holes 34 communicating with the second cavity 22. The second cavity 22 may be defined inside the second body 12, and the second cavity 22 may be located opposite the first cavity 21. Specifically, the second opening 22*a* of the second cavity 22 may be aligned with the first opening 21*a* of the first cavity 21. The second cavity 22 may have a volume capable of receiving a portion of the locking member 13, and thus the locking member 13 may be partially received in the second cavity 22 through the second opening 22*a*. The second body 12 may have a closed wall 12*a* facing the second opening 22*a*, and the plurality of vent holes 34 may be drilled in the closed wall 12*a*. Thus, the plurality of vent holes 34 may face the second opening 22*a*. When the locking member 13 moves to the second cavity 22, the air contained in the second cavity 22 may be discharged to the outside of the second body 12 through the plurality of vent holes 34 so that the locking member 13 may easily move inside the second cavity 22 of the second body 12.

Figure 9:
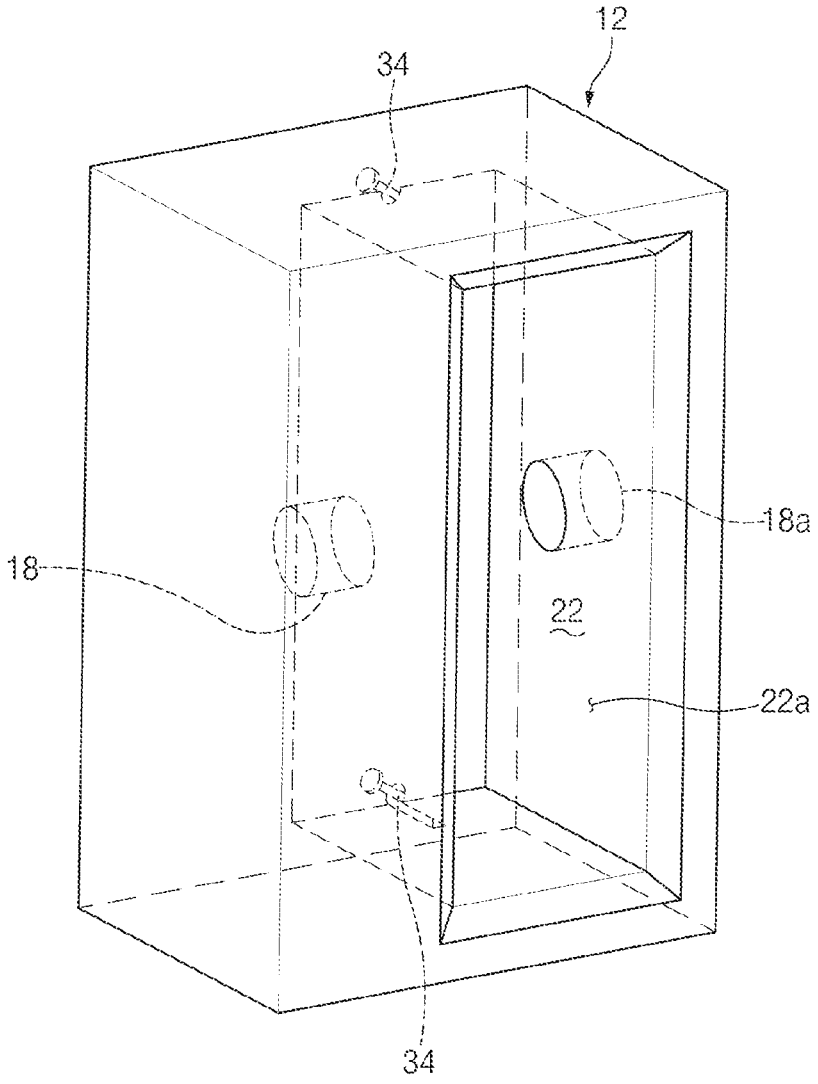
FIG. 9 illustrates a perspective view of a second body in a locking mechanism for pillarless doors according to an exemplary embodiment of the present disclosure.
Figure 10:
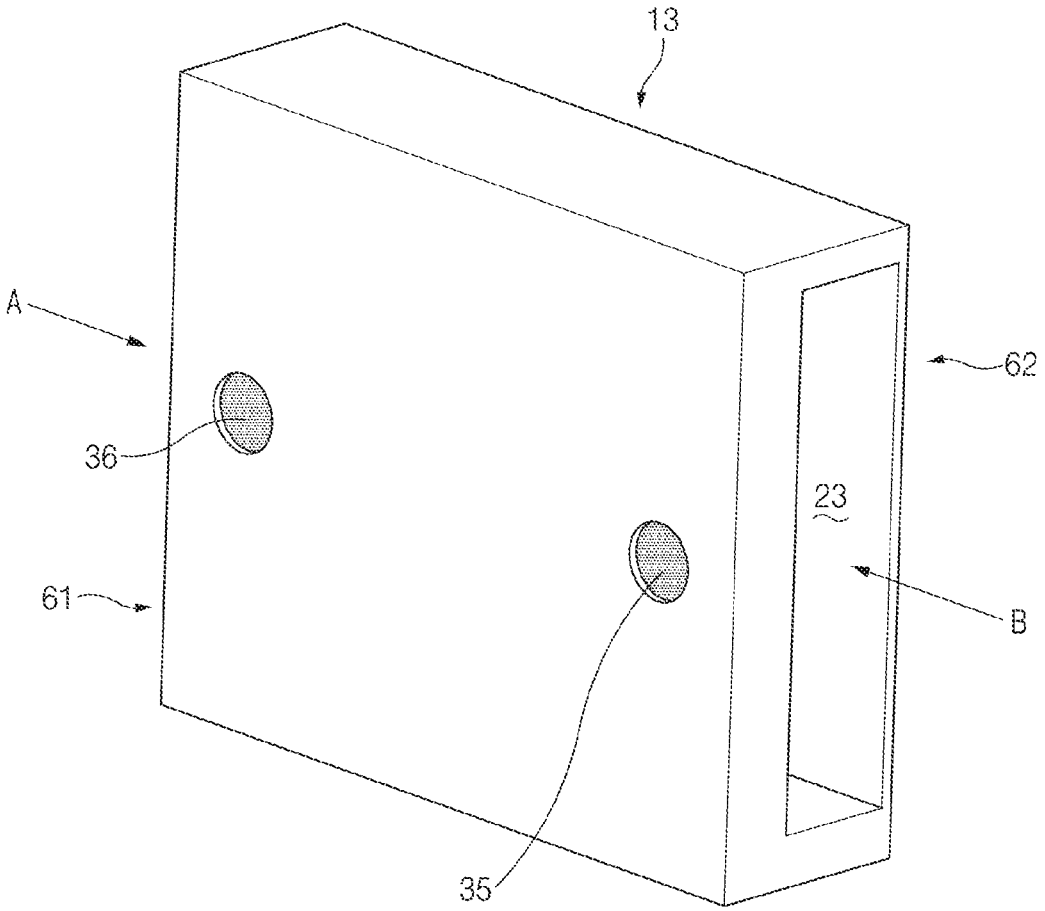
FIG. 10 illustrates a perspective view of a locking member in a locking mechanism for pillarless doors according to an exemplary embodiment of the present disclosure.
Figure 11:
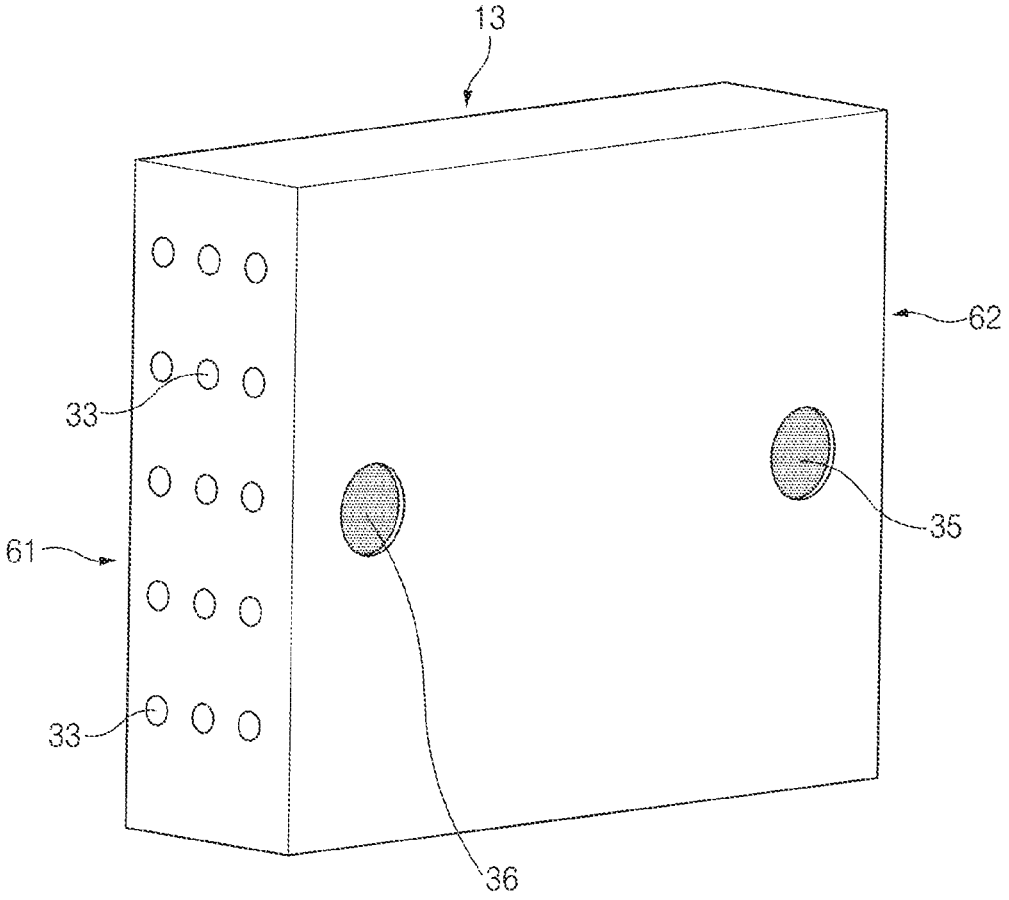
FIG. 11 illustrates a view, which is viewed from a direction indicated by arrow A in FIG. 10.
Figure 12:
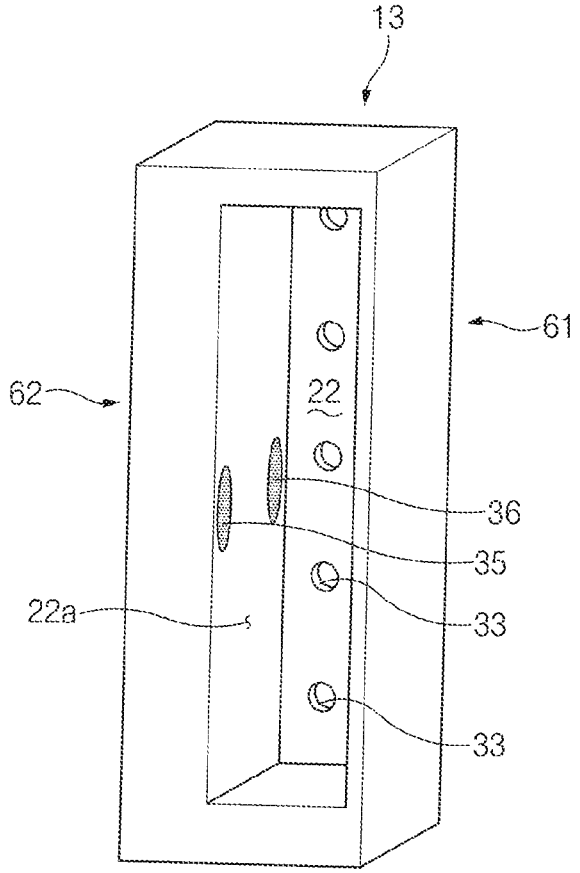
FIG. 12 illustrates a view, which is viewed from a direction indicated by arrow B in FIG. 10.

Referring to FIG. 9, the second body 12 may include a second locking recess 18 and a second tooling hole 18*a* which communicate with the second cavity 22. The second cavity 22 may be defined within the second body 12, and the second cavity 22 may have a shape corresponding to that of the locking member 13, so that the locking member 13 may be movably received in the second cavity 22 of the second body 12. The second locking recess 18 may be aligned with the second tooling hole 18*a* in a width direction of the second body 12. The second locking recess 18 and the second tooling hole 18*a* may be formed by drilling in the width direction of the second body 12. The second locking recess 18 may be provided in one sidewall of the second body 12, and the second tooling hole 18*a* may be provided in the other sidewall of the second body 12. The second locking recess 18 and the second tooling hole 18*a* may face each other in relation to the second cavity 22. The second locking recess 18 may be formed not to be through one sidewall of the second body 12, and the second tooling hole 18*a* may be formed to be through the other sidewall of the second body 12.

Referring to FIG. 1, in a state in which the first side door 3 and the second side door 4 are closed, the first body 11 may be aligned with the second body 12 in a longitudinal direction of the vehicle and the first body 11 may be adjacent to the second body 12. For example, a longitudinal axis of the first body 11 may coincide with a longitudinal axis of the second body 12, and the first cavity 21 of the first body 11 may be located opposite the second cavity 22 of the second body 12 in a state in which the first side door 3 and the second side door 4 are closed. Thus, the locking member 13 may move between the first cavity 21 and the second cavity 22.

The locking mechanism 10 for pillarless doors according to an exemplary embodiment of the present disclosure may include a gas generator 40 generating gas in the event of a collision of the vehicle to move the locking member 13. In particular, the gas generator 40 may allow the gas generated in the collision of the vehicle to push the locking member 13 received in the first cavity 21 of the first body 11 toward the second cavity 22 of the second body 12.

The gas generator 40 may include a squib 41 and an inflator chamber 42 containing a gas generant 28 to be burned by ignition of the squib 41.

The squib 41 may be mounted on the first body 11, and a controller 50 such as an airbag control unit may be electrically connected to the squib 41.

The inflator chamber 42 may be defined inside the first body 11, and the inflator chamber 42 may be open to the first cavity 21 of the first body 11. The inflator chamber 42 may contain the gas generant 28. The inflator chamber 42 may be separated from the first cavity 21 by a burst membrane 26. The burst membrane 26 may seal the inflator chamber 42. The burst membrane 26 may be made of a frangible or rupturable material such as sponge, and thus the burst membrane 26 may be easily ruptured when a pressure in the inflator chamber 42 is higher than or equal to a predetermined pressure.

The gas generator 40 may further include a cushion membrane 27 provided within the inflator chamber 42, and the cushion membrane 27 may face the burst membrane 26. The cushion membrane 27 may be made of a cushion material such as sponge. The cushion membrane 27 may be attached to an inner surface of the closed wall 11*a* of the first body 11. The cushion membrane 27 may aid in holding the gas generant 28 in place and/or cushioning the gas generant 28 against vibration and impact.

The squib 41 may be located opposite the inflator chamber 42, and the squib 41 may contain a heating circuit such as a filament and gunpowder therein. An igniter material 43 may be disposed around the squib 41. When an electric signal is applied to the squib 41 by the controller 50 such as the airbag control unit, the squib 41 may ignite the igniter material 43, and the gas generant 28 may be burned by the ignition of the igniter material 43, and thus a large amount of gas may be generated instantaneously in the inflator chamber 42.

Figure 3:
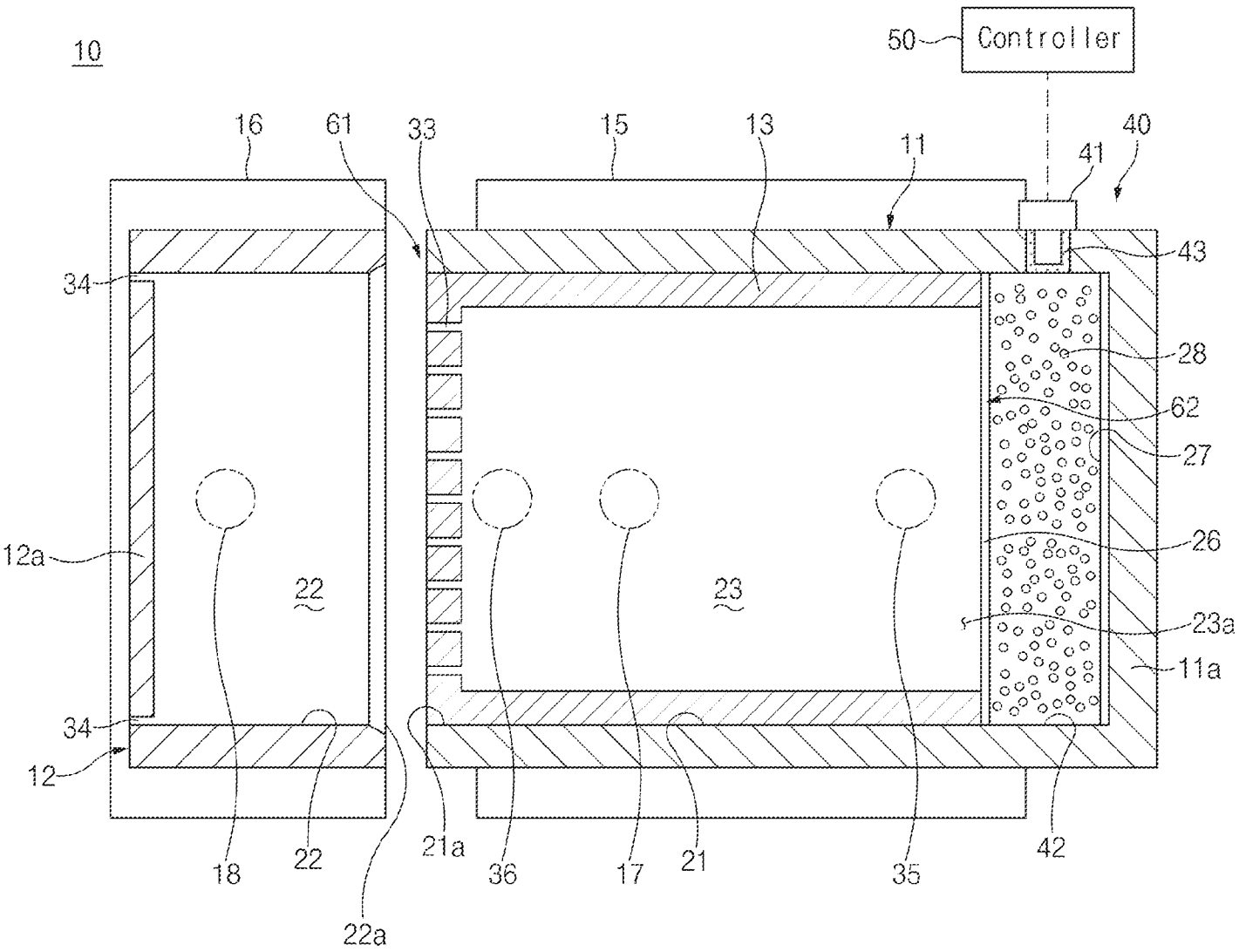
FIG. 3 illustrates a vertical sectional view of the locking mechanism for pillarless doors illustrated in FIG. 2.
Figure 4:
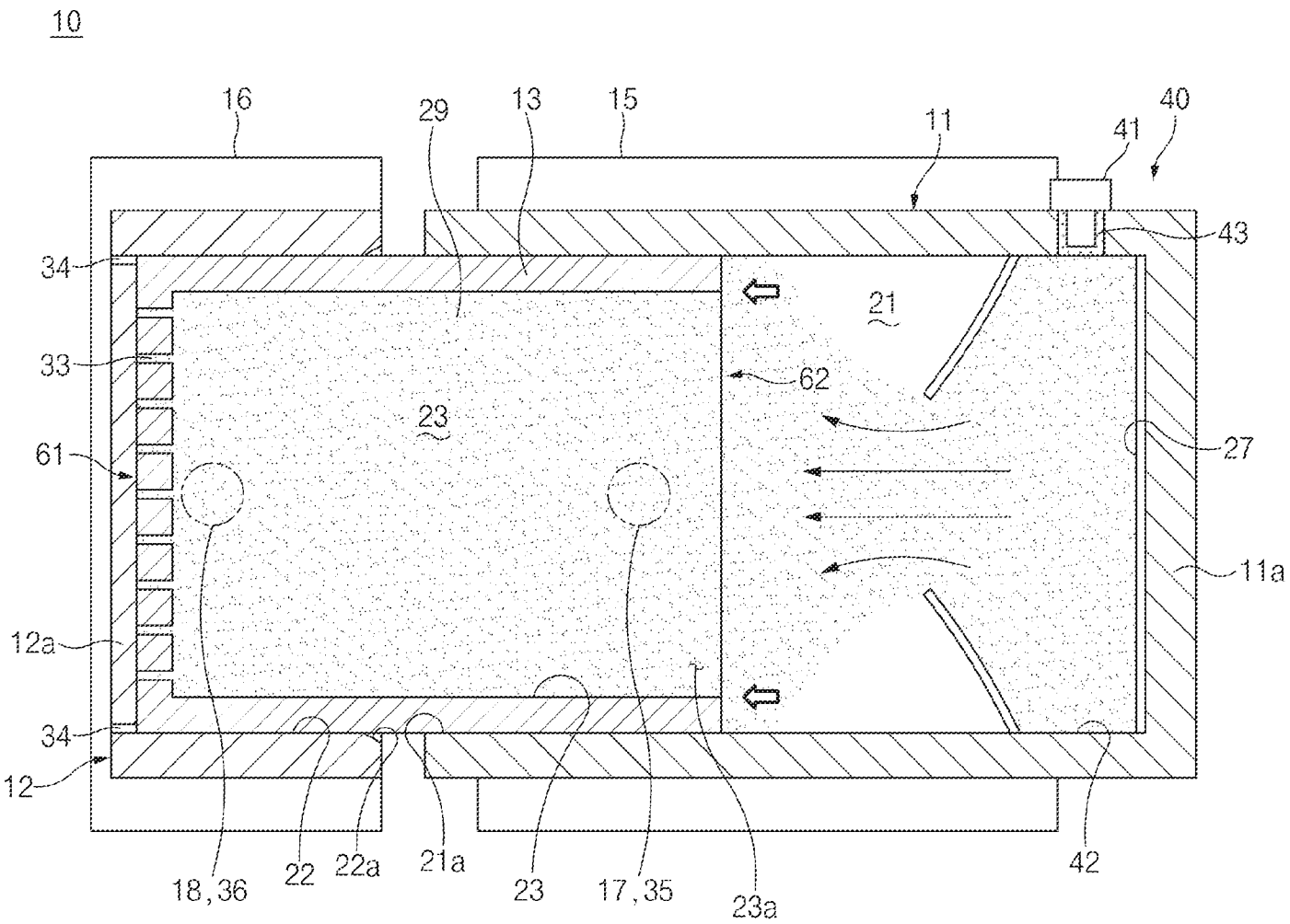
FIG. 4 illustrates a state of a locking member illustrated in FIG. 3, in which the locking member moves toward a second cavity of a second body.
Figure 5:
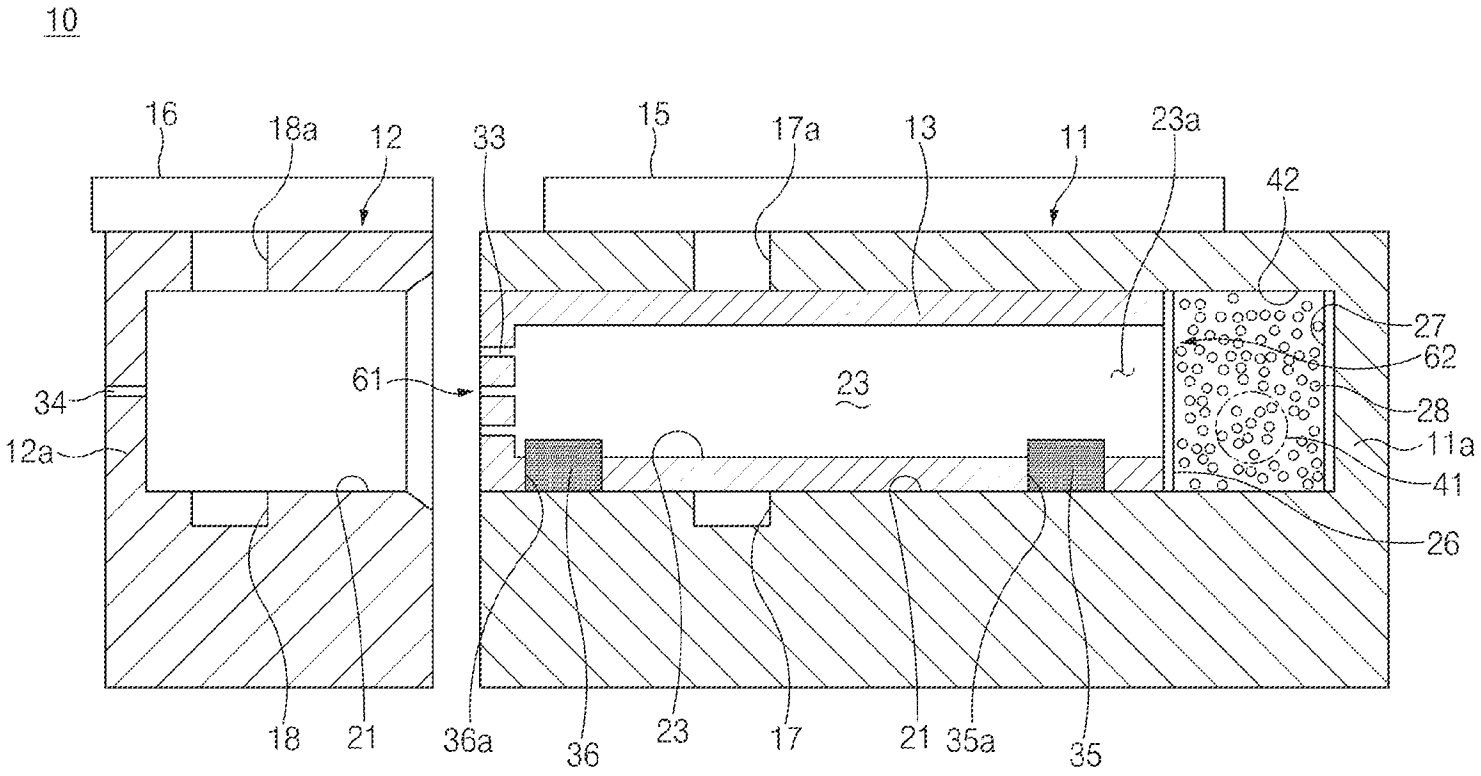
FIG. 5 illustrates a horizontal sectional view of the locking mechanism for pillarless doors illustrated in FIG. 2.
Figure 6:
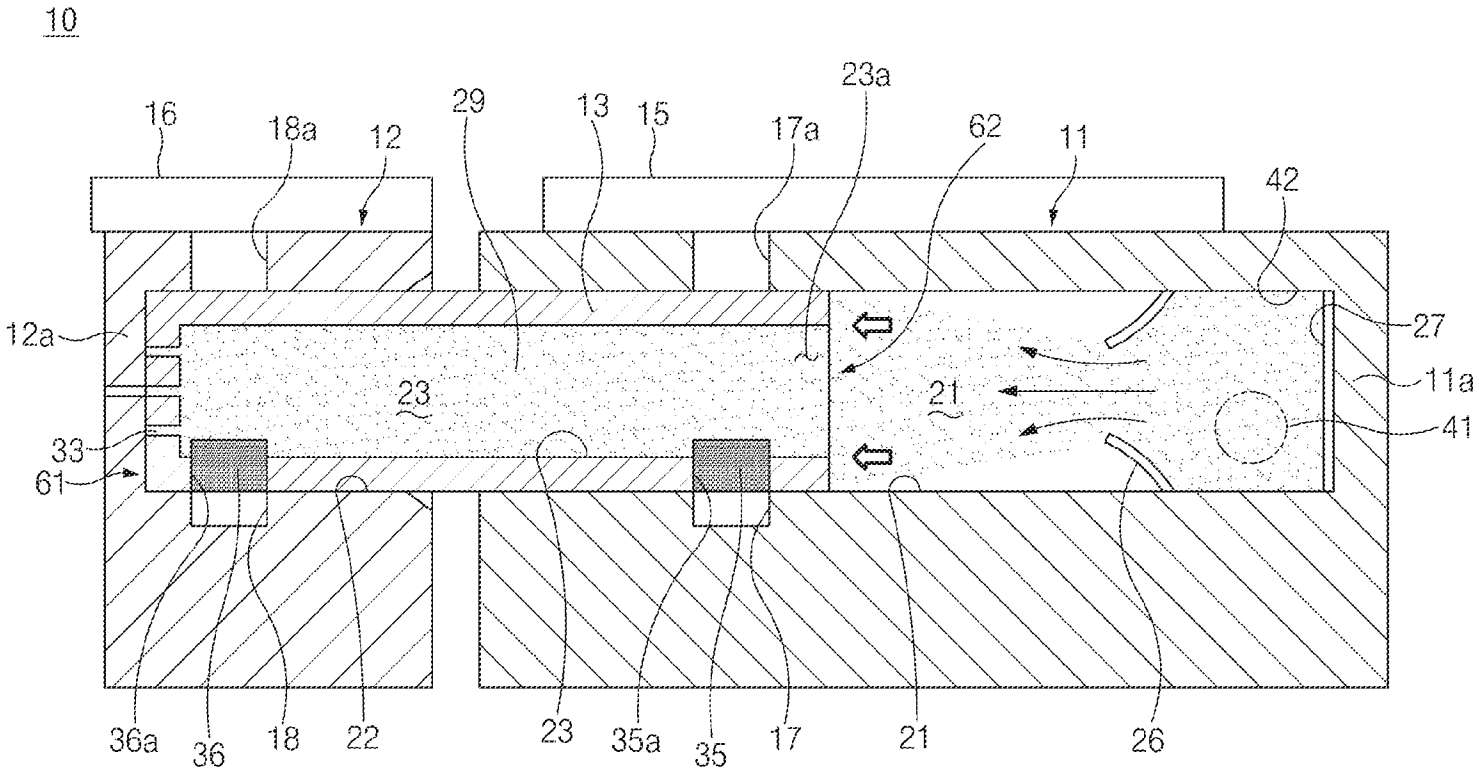
FIG. 6 illustrates a state of a locking member illustrated in FIG. 5, in which the locking member extends from a first cavity of a first body to a second cavity of a second body.

Referring to FIGS. 3 and 5, when the gas generator 40 does not operate (that is, the gas generator 40 does not generate the gas), the locking member 13 may be completely received in the first cavity 21 of the first body 11. Referring to FIGS. 4 and 6, when the gas generator 40 operates (that is, the gas generator 40 generates the gas), the locking member 13 may be moved toward the second cavity 22 by the gas so that a portion of the locking member 13 may be received in the second cavity 22 of the second body 12, and the rest of the locking member 13 may be received in the first cavity 21 of the first body 11.

Referring to FIGS. 3, 5, and 10 to 12, the locking member 13 may include a first end face 61 facing the second body 12 and a second end face 62 facing the burst membrane 26. The locking member 13 may have a third cavity 23 receiving the gas generated by the gas generator 40, a plurality of vent holes 33 communicating with the third cavity 23, and a third opening 23*a* communicating with the third cavity 23. The third cavity 23 may be defined inside the locking member 13. The plurality of vent holes 33 may be provided in the first end face 61 of the locking member 13, and the third opening 23*a* may be provided in the second end face 62. When the locking member 13 moves to the second cavity 22, the air or gas received in the third cavity 23 may be discharged to the outside of the locking member 13 through the plurality of vent holes 33 so that the locking member 13 may move easily within the second cavity 22 of the second body 12. Referring to FIGS. 3 and 4, the vent holes 33 of the locking member 13 may not be aligned with the vent holes 34 of the second body 12.

Figure 7:
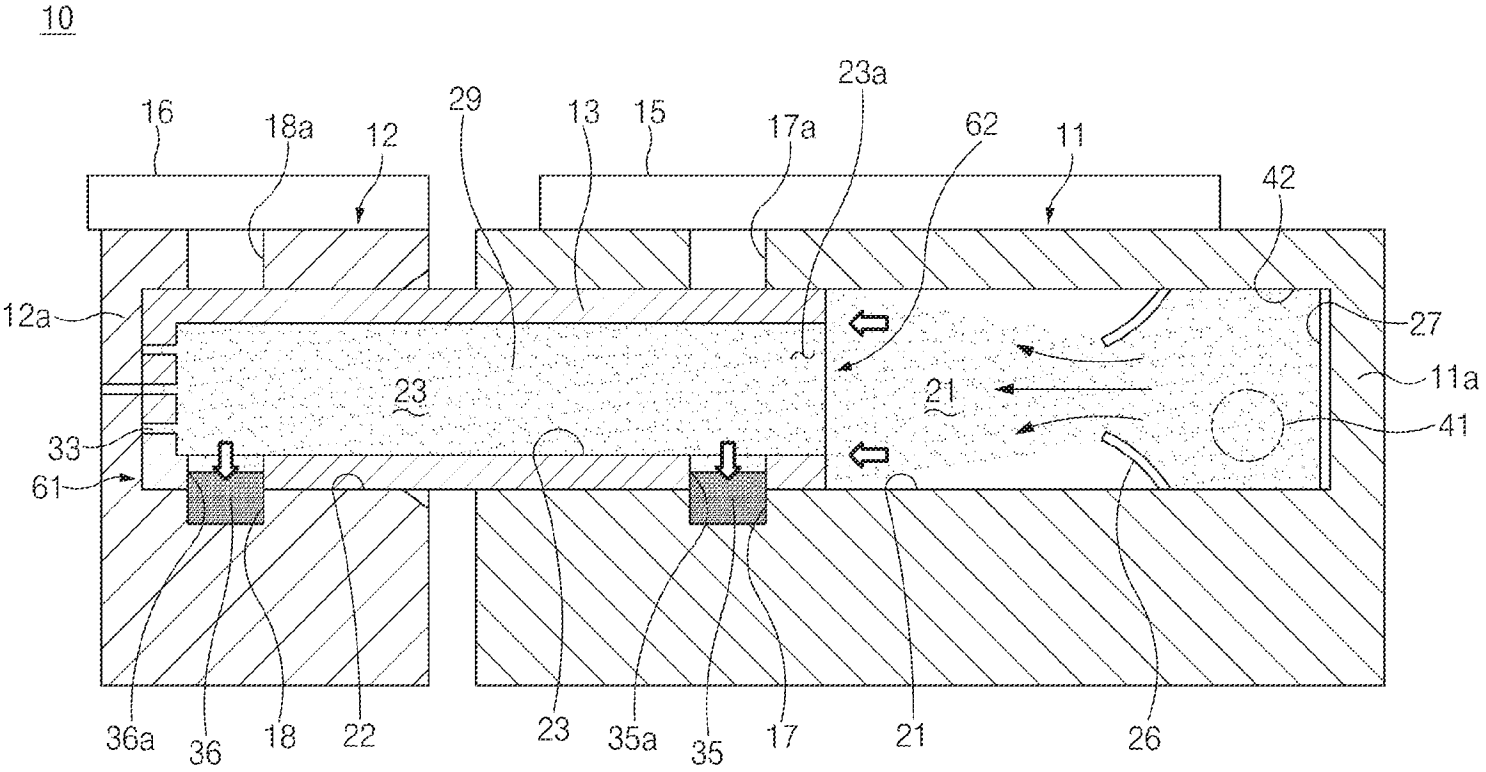
FIG. 7 illustrates a state of the locking member illustrated in FIG. 6, in which a portion of a first locking pin of the locking member is received in a first locking recess of the first body, and a portion of a second locking pin of the locking member is received in a second locking recess of the second body.

Referring to FIGS. 5 to 7, the locking member 13 may include a first through hole 35*a* communicating with the third cavity 23, a first locking pin 35 movably received in the first through hole 35*a*, a second through hole 36*a* communicating with the third cavity 23, and a second locking pin 36 movably received in the second through hole 36*a*. The first through hole 35*a* may be formed in one sidewall of the locking member 13, and the first through hole 35*a* and the first locking pin 35 may be adjacent to the second end face 62. The second through hole 36*a* may be formed in one sidewall of the locking member 13, and the second through hole 36*a* and the second locking pin 36 may be adjacent to the first end face 61. As a pressure in the third cavity 23 increases, the first locking pin 35 and the second locking pin 36 may move toward the outside of the locking member 13.

Figure 8:
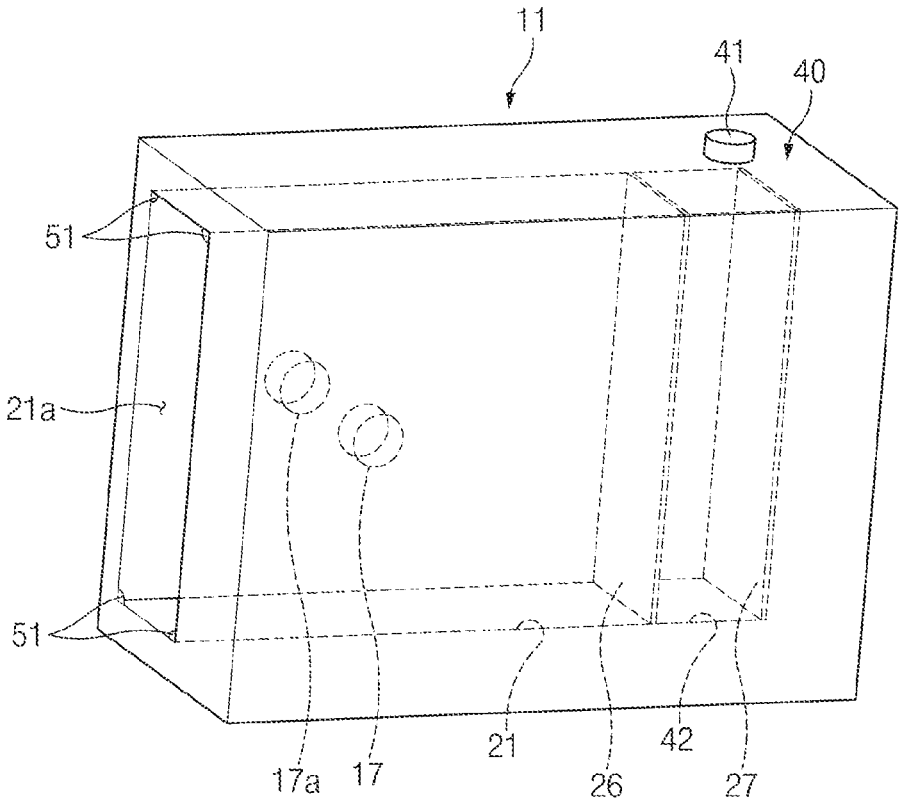
FIG. 8 illustrates a perspective view of a first body in a locking mechanism for pillarless doors according to an exemplary embodiment of the present disclosure.

Referring to FIG. 8, the first body 11 may include a plurality of tearing plates 51 disposed around the first opening 21*a*, and each tearing plate 51 may be made of a frangible material which is easily breakable when a predetermined force is applied thereto. For example, the plurality of tearing plates 51 may be disposed on corner portions of the first opening 21*a*, and the plurality of tearing plates 51 may support the first end face 61 of the locking member 13. In a state in which the collision of the vehicle does not occur (that is, the controller 50 does not detect the collision of the vehicle, and the gas generator 40 does not operate), the locking member 13 may be held in the first cavity 21 by the plurality of tearing plates 51.

When the collision of the vehicle occurs, the controller 50 such as the airbag control unit may detect the collision, and the controller 50 may transmit an electric signal corresponding to the collision to the squib 41 of the gas generator 40 to allow the squib 41 to ignite the igniter material 43. The gas generant 28 may be burned by the ignition of the igniter material 43, and a large amount of gas may be generated instantaneously in the inflator chamber 42. As illustrated in FIGS. 4 and 6, as a pressure in the inflator chamber 42 increases to a predetermined pressure or higher, the burst membrane 26 may be ruptured, and thus the gas may flow from the inflator chamber 42 into the third cavity 23 of the locking member 13, and the locking member 13 may be moved toward the second cavity 22 of the second body 12 by the pressure of the gas 29 flowing into the third cavity 23. Accordingly, the first end face 61 of the locking member 13 may be received in the second cavity 22 of the second body 12, and the second end face 62 of the locking member 13 may be received in the first cavity 21 of the first body 11, and thus the locking member 13 may extend between the first cavity 21 of the first body 11 and the second cavity 22 of the second body 12, and the locking member 13 may physically or mechanically connect the first body 11 and the second body 12.

Referring to FIGS. 4 and 6, as the gas generated by the gas generator 40 flows into the third cavity 23 of the locking member 13, the first end face 61 of the locking member 13 may be received in the second cavity 22 of the second body 12, and the first end face 61 of the locking member 13 may contact the closed wall 12*a* of the second body 12. When the first end face 61 of the locking member 13 contacts the closed wall 12*a* of the second body 12, the first through hole 35*a* may be aligned with the first locking recess 17 of the first body 11, and the second through hole 36*a* may be aligned with the second locking recess 18 of the second body 12. The vent holes 33 of the locking member 13 may be closed by the closed wall 12*a* of the second body 12, and the vent holes 34 of the second body 12 may be closed by the first end face 61 of the locking member 13. As illustrated in FIG. 7, the first locking pin 35 and the second locking pin 36 may be moved toward the outside of the locking member 13 by the pressure of the gas received in the third cavity 23 of the locking member 13. As the first locking pin 35 moves to the first locking recess 17 through the first through hole 35*a*, a portion of the first locking pin 35 may be received in the first locking recess 17 and the rest of the first locking pin 35 may be received in the first through hole 35*a*, and thus the first locking pin 35 may combine the locking member 13 and the first body 11. As the second locking pin 36 moves to the second locking recess 18 through the second through hole 36*a*, a portion of the second locking pin 36 may be received in the second locking recess 18 and the rest of the second locking pin 36 may be received in the second through hole 36*a*, and thus the second locking pin 36 may combine the locking member 13 and the second body 12. In this way, the first locking pin 35 may combine the locking member 13 and the first body 11, and the second locking pin 36 may combine the locking member 13 and the second body 12 so that the locking member 13 may be held simultaneously in the first body 11 and the second body 12, and thus the locking member 13 may securely lock the first side door 3 and the second side door 4.

When the collision of the vehicle occurs in a state in which the first side door 3 and the second side door 4 are closed, the locking member 13 may be moved toward the second body 12 by the gas generated by the gas generator 40 so that the locking member 13 may lock the first body 11 and the second body 12, and thus the first body 11, the locking member 13, and the second body 12 may define a load path L (see FIG. 1) through which a load passes. That is, the first body 11, the locking member 13, and the second body 12 may serve as load members.

Referring to FIG. 1, the first side door 3 may have a first upper impact beam 5*a* adjacent to an upper end of the first side door 3 and a first lower impact beam 5*b* adjacent to a lower end of the first side door 3, and the first body 11 may be aligned with the first upper impact beam 5*a*. The second side door 4 may have a second upper impact beam 6*a* adjacent to an upper end of the second side door 4 and a second lower impact beam 6*b* adjacent to a lower end of the second side door 4, and the second body 12 may be aligned with the second upper impact beam 6*a*. Thus, the load path L defined by the first body 11, the locking member 13, and the second body 12 may extend along the first upper impact beam 5*a* and the second upper impact beam 6*a*.

According to the above-described exemplary embodiments of the present disclosure, when the collision of the vehicle occurs, the locking member 13 may physically or mechanically connect the first body 11 mounted on the first side door 3 and the second body 12 mounted on the second side door 4, thereby defining the load path L. Since an impact load is transmitted through the load path L, the first side door 3 and the second side door 4 may be minimally parted. In addition, the side doors 3 and 4 may be prevented from breaking into a passenger compartment, and thus crashworthiness may be significantly improved.

As set forth above, according to exemplary embodiments of the present disclosure, the locking member may securely lock the first side door and the second side door by physically or mechanically connecting the first body mounted on the first side door and the second body mounted on the second side door in the event of the vehicle collision, and thus the load path may be defined along the first body, the locking member, and the second body. Since the load generated in the vehicle collision can be transmitted through the first side door, the locking member, and the second side door, the first side door and the second side door may be minimally parted. Since each of the side doors can be prevented from breaking into the passenger compartment, crashworthiness may be significantly improved and occupant injury may be reduced.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A locking mechanism for pillarless doors, the locking mechanism comprising:

a first body mounted on a first side door, the first body having a first cavity, a first opening communicating with the first cavity, and a plurality of tearing plates disposed around the first opening, wherein each tearing plate is made of a frangible material that is breakable by a predetermined force;

a second body mounted on a second side door and having a second cavity opposite the first cavity, wherein the first opening is located opposite the second body;

a locking member configured to be movably received between the first cavity of the first body and the second cavity of the second body; and a gas generator including a squib and an inflator chamber containing a gas generant configured to be burned by ignition of the squib, wherein the inflator chamber is separated from the first cavity by a burst membrane and wherein the plurality of tearing plates is configured to support a first end face of the locking member when the gas generator does not operate.

2. The locking mechanism according to claim 1, wherein:

the first cavity has a volume capable of receiving the whole locking member; and the second cavity has a volume capable of receiving a portion of the locking member.

3. The locking mechanism according to claim 2, wherein:

the second body includes a second opening communicating with the second cavity; and the second opening is located opposite the first body.

4. The locking mechanism according to claim 2, wherein the first body is aligned with the second body in a longitudinal direction of a vehicle when the first side door and the second side door are closed.

5. The locking mechanism according to claim 2, wherein the burst membrane is made of a frangible or rupturable material which is configured to be ruptured when a pressure in the inflator chamber is higher than or equal to a predetermined pressure.

6. The locking mechanism according to claim 3, wherein:

the second body includes a plurality of vent holes communicating with the second cavity; and the plurality of vent holes faces the second opening.

7. The locking mechanism according to claim 1, wherein:

the second body includes a second opening communicating with the second cavity; and the second opening is located opposite the first body.

8. The locking mechanism according to claim 7, wherein:

the second body includes a plurality of vent holes communicating with the second cavity; and the plurality of vent holes faces the second opening.

9. The locking mechanism according to claim 1, wherein the first body is aligned with the second body in a longitudinal direction of a vehicle when the first side door and the second side door are closed.

10. The locking mechanism according to claim 1, wherein the burst membrane is made of a frangible or rupturable material which is configured to be ruptured when a pressure in the inflator chamber is higher than or equal to a predetermined pressure.

11. A locking mechanism for pillarless doors, the locking mechanism comprising:

a first body mounted on a first side door and having a first cavity;

a second body mounted on a second side door and having a second cavity opposite the first cavity;

a gas generator including a squib and an inflator chamber containing a gas generant configured to be burned by ignition of the squib, wherein the inflator chamber is separated from the first cavity by a burst membrane; and a locking member configured to be movably received between the first cavity of the first body and the second cavity of the second body, the locking member including a first end face facing the second body and a second end face facing the burst membrane;

wherein the locking member includes a third cavity configured to receive a gas generated by the gas generator, a plurality of vent holes communicating with the third cavity, and a third opening communicating with the third cavity;

wherein the plurality of vent holes is provided in the first end face; and wherein the third opening is provided in the second end face.

12. The locking mechanism according to claim 11, wherein when the gas generator operates, the locking member is configured to move toward the second cavity of the second body so that the first end face of the locking member is received in the second cavity of the second body, and the second end face of the locking member is received in the first cavity of the first body.

13. The locking mechanism according to claim 11, wherein:

the locking member includes a first through hole communicating with the third cavity, a first locking pin configured to be movably received in the first through hole, a second through hole communicating with the third cavity, and a second locking pin configured to be movably received in the second through hole; and the first locking pin and the second locking pin are configured to be moved toward the outside of the locking member by a pressure of the gas received in the third cavity.

14. The locking mechanism according to claim 13, wherein:

the first body includes a first locking recess communicating with the first cavity;

the second body includes a second locking recess communicating with the second cavity; and when the first end face of the locking member contacts an inner surface of the second body by operation of the gas generator, the first through hole is aligned with the first locking recess, and the second through hole is aligned with the second locking recess.

15. A vehicle comprising:

a first side door mounted on a first side of the vehicle;

a second side door mounted on the first side of the vehicle;

a first body mounted on the first side door and having a first cavity;

a second body mounted on the second side door, the second body having a second cavity opposite the first cavity, a second opening communicating with the second cavity, and a plurality of vent holes communicating with the second cavity, wherein the second opening is located opposite the first body and the plurality of vent holes face the second opening;

a locking member configured to be movably received between the first cavity of the first body and the second cavity of the second body; and a gas generator including a squib and an inflator chamber containing a gas generant configured to be burned by ignition of the squib, wherein the inflator chamber is separated from the first cavity by a burst membrane.

16. The vehicle according to claim 15, wherein:

the first cavity has a volume capable of receiving the whole locking member; and the second cavity has a volume capable of receiving a portion of the locking member.

17. The vehicle according to claim 15, wherein the first body includes:

a first opening communicating with the first cavity, the first opening being located opposite the second body; and a plurality of tearing plates disposed around the first opening, the plurality of tearing plates configured to support a first end face of the locking member when the gas generator does not operate, wherein each tearing plate is made of a frangible material which is breakable by a predetermined force.

18. The vehicle according to claim 15, wherein the first body is aligned with the second body in a longitudinal direction of the vehicle when the first side door and the second side door are closed.

19. The vehicle according to claim 15, wherein the burst membrane is made of a frangible or rupturable material which is configured to be ruptured when a pressure in the inflator chamber is higher than or equal to a predetermined pressure.

20. The vehicle according to claim 15, wherein the locking member includes:

a first end face facing the second body and a second end face facing the burst membrane;

a third cavity configured to receive a gas generated by the gas generator;

a plurality of vent holes provided in the first end face and communicating with the third cavity;

a third opening provided in the second end face and communicating with the third cavity;

a first through hole communicating with the third cavity;

a first locking pin configured to be movably received in the first through hole;

a second through hole communicating with the third cavity; and a second locking pin configured to be movably received in the second through hole, wherein the first locking pin and the second locking pin are configured to be moved toward the outside of the locking member by a pressure of the gas received in the third cavity.

* * * * *